US005529647A

United States Patent [19]

Taylor et al.

[11] Patent Number: 5,529,647

[45] Date of Patent: Jun. 25, 1996

[54] GAS GENERANT COMPOSITION FOR USE WITH ALUMINUM COMPONENTS

[75] Inventors: Robert D. Taylor, Hyrum; Thomas M. Deppert, Brigham City, both of Utah

[73] Assignee: Morton International, Inc., Chicago, Ill.

[21] Appl. No.: 165,131

[22] Filed: Dec. 10, 1993

[51] Int. Cl.[6] ..... C06B 45/00

[52] U.S. Cl. ..... 149/2; 149/17; 149/46; 149/61; 149/70; 149/76; 149/77

[58] Field of Search ..... 149/2, 17, 46, 149/61, 70, 76, 77

[56] References Cited

U.S. PATENT DOCUMENTS

| | | | |
|---|---|---|---|
| 3,797,854 | 3/1974 | Poole et al. | 280/150 AB |
| 4,008,109 | 2/1977 | Norton | 149/37 |
| 4,369,079 | 1/1983 | Shaw | 149/2 |
| 4,376,002 | 3/1983 | Lechoslaw | 149/35 |
| 4,386,979 | 6/1983 | Jackson, Jr. | 149/21 |
| 4,931,112 | 6/1990 | Wardle et al. | 149/88 |
| 4,948,439 | 8/1990 | Poole et al. | 149/46 |
| 5,010,804 | 4/1991 | Lee | 89/7 |
| 5,035,757 | 7/1991 | Poole | 149/46 |
| 5,052,272 | 10/1991 | Lee | 89/7 |
| 5,139,588 | 8/1992 | Poole | 149/61 |
| 5,160,386 | 11/1992 | Lund et al. | 149/88 |
| 5,197,758 | 3/1993 | Lund et al. | 280/741 |
| 5,204,068 | 4/1993 | O'Loughlin et al. | 422/180 |
| 5,386,775 | 2/1995 | Poole et al. | 102/289 |
| 5,431,103 | 7/1995 | Hock et al. | 102/287 |

FOREIGN PATENT DOCUMENTS

| | | | |
|---|---|---|---|
| B514705 | 2/1981 | Australia | C06B 3/08 |
| 0405962 | 1/1991 | European Pat. Off. . | |
| 0438851 | 7/1991 | European Pat. Off. | C06D 5/06 |
| 0474115 | 3/1992 | European Pat. Off. | C06D 5/06 |
| 0519485 | 6/1992 | European Pat. Off. | C06D 5/06 |
| A644073 | 10/1950 | United Kingdom | C06D 5/06 |

*Primary Examiner*—Charles T. Jordan
*Assistant Examiner*—John R. Hardee
*Attorney, Agent, or Firm*—Wayne E. Nacker; Gerald K. White

[57] ABSTRACT

A gas generant composition adapted for use with airbag restraint systems containing aluminum components includes a fuel which is a tetrazole or a triazole, an oxidizer which is an ammonium, alkali metal and/or alkaline earth metal salt of a chlorate, perchlorate or nitrate, alumina and a binder.

7 Claims, No Drawings

GAS GENERANT COMPOSITION FOR USE WITH ALUMINUM COMPONENTS

The present invention is directed to gas generant compositions suitable for automotive air bag restraint systems, particularly restraint systems in which the gas generant is encased in aluminum housing and/or generates gases which come into contact with aluminum components, such as filters.

BACKGROUND OF THE INVENTION

Most automotive air bag restraint systems, presently in use, use gas generant compositions in which sodium azide is the principal fuel. Because of disadvantages with sodium azide, particularly instability in the presence of metallic impurities and toxicity, which presents a disposal problem for unfired gas generators, there is a desire to develop non-azide gas generant systems and a number of non-azide formulations have been proposed. However, to date, non-azide gas generants have not made significant commercial inroads.

U.S. Pat. No. 5,139,588, the teachings of which are incorporated herein by reference, describes gas generant compositions which use as fuel tetrazole and triazole compounds such as aminotetrazole, tetrazole, bitetrazole, 1,2,4-triazole-5-one, 3-nitro-1,2,4-triazole-5-one and metal salts thereof. The formulations further contain oxidizers, including alkaline and alkaline earth metal salts of nitrates, chlorates and perchlorates. This patent teaches that the cations of the fuel and oxidizer salts should include a mixture of alkaline and alkaline earth metal cations, whereby the salts formed during combustion include both liquid and solid salts that together form filterable clinkers. Furthermore, the compositions of this patent include materials such as silicon dioxide, boric oxide and vanadium pentoxide which reacts with corrosive oxides, such as potassium or sodium oxide, forming mixed metal salts.

It is noted in U.S. Pat. No. 5,139,588 that the compositions are useful in aspirator systems. These systems, which are generally no longer used, were typically made of steel. Space, cost and weight requirements of the present day automotive industry generally require small aluminum units in which the gas is provided entirely by the gas generant, not by venturi action in conjunction with gas generation. While an aluminum housing and other aluminum components have the advantages of being lightweight and easily machined, and therefore inexpensive to produce, aluminum has the disadvantage of being a highly reactive metal, e.g., as compared to steel. In particular, aluminum is rapidly degraded by alkali metal oxides such as $Na_2O$ and $K_2O$, particularly at high temperatures. Gas generant compositions based on azoles, as in the U.S. Pat. No. 5,139,588, burn at much higher temperatures than do sodium azide-based gas generant compositions. Accordingly, the problem of degradation of aluminum by alkali metal oxides is exacerbated. There is a need for gas generant compositions to be used in conjunction with aluminum component-containing gas generant systems in which alkali metal oxides are more efficiently scavenged.

U.S. Pat. No. 5,139,588 furthermore describes the formation of pellets of the compositions by compression molding. If pellets are the form of gas generant composition to be utilized, as is frequently the case, the pellets must remain in that form over an extended period of time, during which the pellets will be subject to frequent vibration and other mechanical shocks. It is not believed that azole-based pellets, formed by compression molding, without a binder, would exist in that form for long when the gas generant module is employed in a vehicle and subject to jarring and vibration.

SUMMARY OF THE INVENTION

A gas generant composition using an azole as the fuel component and an oxidizer therefor, also contains alumina ($Al_2O_3$) as a scavenger of alkali metal oxides. The gas generant composition further contains a binder to ensure that pellets formed from the composition remain intact when employed, for example, in an automotive air bag restraint system.

DETAILED DESCRIPTION OF CERTAIN PREFERRED EMBODIMENTS

The fuel, which comprises between about 20 and about 45 wt % of the gas generant composition, is a tetrazole or triazole compound, such as aminotetrazole, tetrazole, bitetrazole, 1,2,4-triazole-5-one, 3-nitro-1,2,4-triazole-5-one, metal salts of these compounds and mixtures thereof. A preferred fuel is aminotetrazole and its alkali and alkaline earth metal salts.

The oxidizer, which is used at a level of between about 50 and about 75 wt % is selected from ammonium, alkali metal and alkaline earth metal chlorates, perchlorates, nitrates and mixture thereof. Preferred oxidizers are nitrates. It is preferred at least a portion of the oxidizer, i.e., at least about 1.0 wt % of the gas generant composition, be sodium nitrate, as this has a relatively low ignition temperature.

Optionally, a portion of the oxidizer may be a transition metal oxide, such as iron oxide. In addition to their oxidizing function, these oxides provide hard particles, facilitating compaction of the composition into pellets or other consolidated solid shapes.

As is taught in above-referenced U.S. Pat. No. 5,139,588, it is preferred that the cations of the fuel salts and oxidizers be a mixture of alkali metal cations, i.e., lithium, sodium and potassium, and alkaline earth metal cations, i.e., magnesium, strontium, barium and cerium. Upon combustion, the alkali cations form liquid oxides and the alkaline earth metal cations form solid oxides, the mixture of liquid and solid salts forming clinkers which can be readily removed from the gas stream by filtration. The ratio of solid to liquid combustion salts may be adjusted by the ratio of alkaline earth metal cations to alkali metal cations. Of alkali metal cations, sodium is preferred over potassium as sodium oxide is more readily scavenged by alumina than potassium oxide.

In accordance with the present invention, it is found that alumina is a particularly efficient scavenger of corrosive alkali metal oxides, such as sodium oxide and potassium oxide. Accordingly, the composition of the present invention contains alumina at a level of between about 0.5 and about 30 wt %. The alumina may be in the form of alumina particulates or as alumina fibers. Alumina in the form of fibers are preferred, producing a higher burn rate than particulate alumina.

It is preferred that alumina as a scavenger of alkali metal oxides be used to the substantial or total exclusion of silica, another known scavenger. Silica in the presence of sodium oxide produces sodium silicate in combination with silica, a combination which melts at a low temperature and produces particulates which are hard to filter. Alumina, instead, results in readily filterable $NaAlO_2$ in the presence of sodium oxide.

Accordingly, it is preferred that gas generant compositions according to the invention contain no more than about 1 wt % silica, preferably no silica.

A binder is added at a level of between about 1 and about 10 wt %. Suitable binder materials include but are not limited to molybdenum disulfide, graphite, polytetrafluroethylene, Viton® (a copolymer of vinylidene fluoride and hexafluoropropylene), nitrocellulose, polysaccharides, polyvinylpyrrolidones, polycarbonates, sodium silicate, calcium stearate, magnesium stearate and mixtures thereof. Preferred binder materials are molybdenum disulfide and polycarbonates.

Alkali metal and alkaline earth metal carbonates and/or oxalates may optionally be added up to about 10 wt %. These act as coolants, lowering the combustion temperature. Generally, if used, these coolants are used at a level of at least about 1 wt %.

As noted above, the alumina may be in the form of fibers. Fibers help to mechanically reinforce the consolidated unburned material and subsequently consolidate slag material formed by burning the composition. Graphite fibers, e.g., at between about 1 and about 10 wt %, may be also be used, either as the sole fibrous material or in conjunction with alumina-containing fibers to perform this reinforcing function.

The invention will now be described in greater detail by way of specific example.

EXAMPLES 1–6

Gas generant compositions in accordance with the present invention are formulated as follows. Burn rate data was generated from pellet burning rates, which pellets were 3 gram 0.5" diameter pellets compacted at 80,000 psi. In examples 1–3, the alumina was 30 nm particulate; in examples 4–6, the alumina was SAFFIL catalytic alumina fibers.

| | (1) | (2) | (3) |
|---|---|---|---|
| AT | 33.27 | 32.54 | 31.81 |
| $NaNO_3$ | 1.00 | 1.00 | 1.00 |
| Sr $(NO_3)2$ | 56.73 | 55.46 | 54.19 |
| $Al_2O_3$ | 7.00 | 9.00 | 11.0 |
| $MoS_2$ | 2.00 | 2.00 | 2.00 |
| Burn Rate (in/Sec) | | | |
| 900 psi | .465 | .365 | .346 |
| 1900 psi | .607 | .553 | .488 |
| Slag | Good | Better | Best |
| | (4) | (5) | (6) |
| AT | 33.27 | 32.54 | 31.81 |
| $NaNO_3$ | 1.00 | 1.00 | 1.00 |
| Sr $(NO_3)_2$ | 56.73 | 55.46 | 54.19 |

-continued

| | | | |
|---|---|---|---|
| $Al_2O_3$ | 7.00 | 9.00 | 11.00 |
| $MoS_2$ | 2.00 | 2.00 | 2.00 |
| Burn Rate (in/Sec) | | | |
| 900 psi | .680 | .623 | .551 |
| 1900 psi | .749 | .798 | .695 |
| Slag | Good | Better | Best |

What is claimed is:

1. A gas generant composition comprising between about 2 and about 45 wt % of a fuel which is a tetrazole or triazole compound selected from the group consisting of aminotetrazole, tetrazole, bitetrazole, 1,2,4-triazole-5-one, 3-nitro-1,2,4-triazole-5-one and mixtures thereof, between about 50 and about 75 wt % of an oxidizer selected from the group consisting of ammonium, alkali metal and alkaline earth metal chlorates, perchlorates, nitrates, transition metal oxides, and mixtures thereof, between about 0.5 and about 30 wt % of alumina fibers, and between about 1 and about 10 wt % of a binder, said gas generant composition containing no more than about 1 wt % silica.

2. A generant composition according to claim 1 wherein said binder is selected from the group consisting of molybdenum disulfide, graphite, polytetrafluoroethylene, vinyl fluoride/hexafluoropropylene copolymer, nitrocellulose, polysaccharides, polyvinylpyrrolidones, polycarbonates, sodium silicate, calcium stearate, magnesium stearate and mixtures thereof.

3. A gas generant according to claim 1 wherein said binder is selected from the group consisting of molybdenum disulfide and polycarbonates.

4. A gas generant composition according to claim 1 wherein sodium nitrate is present as an oxidizer at a level of at least about 1.0 wt % of said composition.

5. A gas generant composition according to claim 1 further containing between about 1 and about 10 wt % of a coolant selected from the group consisting of alkali metal and alkaline earth metal carbonates, oxalates and mixtures thereof.

6. A gas generant composition according to claim 1 further containing between about 1 and about 10 wt % of graphite fibers.

7. A gas generant according to claim 1 containing no silica.

* * * * *